US008347953B1

(12) United States Patent
Elizondo, Jr. et al.

(10) Patent No.: US 8,347,953 B1
(45) Date of Patent: Jan. 8, 2013

(54) INLINE MONITORING PACKAGE FOR ELECTRICAL SUBMERSIBLE PUMP

(75) Inventors: Jesus M. Elizondo, Jr., Norman, OK (US); Keith Kropf, Oklahoma City, OK (US)

(73) Assignee: GE Oil & Gas ESP, Inc.

( * ) Notice: Subject to any disclaimer, the term of this patent is extended or adjusted under 35 U.S.C. 154(b) by 346 days.

(21) Appl. No.: 12/635,922

(22) Filed: Dec. 11, 2009

(51) Int. Cl.
*E21B 47/00* (2006.01)
*E21B 43/12* (2006.01)

(52) U.S. Cl. ..... 166/68; 166/105; 166/66; 166/250.01

(58) Field of Classification Search ..... 166/250.01, 166/66, 68, 105
See application file for complete search history.

(56) References Cited

U.S. PATENT DOCUMENTS

| | | | | |
|---|---|---|---|---|
| 7,624,800 | B2 * | 12/2009 | Jamieson et al. | 166/250.01 |
| 2007/0114040 | A1 * | 5/2007 | Jamieson et al. | 166/380 |
| 2009/0162223 | A1 * | 6/2009 | Lyngholm | 417/410.1 |
| 2010/0047089 | A1 * | 2/2010 | Booker et al. | 417/410.1 |

* cited by examiner

*Primary Examiner* — Giovanna Wright
(74) *Attorney, Agent, or Firm* — Crowe & Dunlevy

(57) ABSTRACT

A submersible pumping system includes a motor, a pump driven by the motor, a seal section disposed between the pump and the motor and an inline monitoring package connected between the seal section and the motor. The inline monitoring package is electrically connected to the motor through a wye point connection. The inline monitoring package preferably includes a sensor array that includes a plurality of sensors configured to measure conditions internal and external to the submersible pumping system. The inline monitoring package further includes a shaft configured to transmit the output from the motor to the pump. The inline monitoring package further includes a fluid exchange system that accommodates the thermal expansion of lubricants in the motor.

16 Claims, 3 Drawing Sheets

INLINE MONITORING PACKAGE FOR ELECTRICAL SUBMERSIBLE PUMP

FIELD OF THE INVENTION

This invention relates generally to the field of submersible pumping systems, and more particularly, but not by way of limitation, to an improved monitoring system for downhole pumping systems.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Monitoring packages are used to provide the operator and automated control systems with real-time information about the performance of the pumping system and the downhole environment.

As illustrated in FIG. 1, a PRIOR ART pumping system 10 includes an electric motor 12, a seal section 14 and a multistage pump 16. Generally, the electric motor 12 transforms electricity supplied from surface-mounted facilities into rotational motion that is supplied to the pump 16 through the seal section 14. A sensor module 18 is attached to the bottom of the motor 12. The sensor module 18 is typically attached to the bottom of the motor 12 through a wye connection and can be configured to provide information about motor operating temperature, wellbore intake pressure, wellbore temperature, pump system vibration, current leakage, discharge temperature, flow rates and discharge pressure. Sensor modules are placed below the motor because it is necessary to closely monitor the performance of the motor and because the sensor module requires electrical power which is available at the motor.

Although widely accepted, the placement of the sensor module 18 at the bottom of the motor 12 may suffer several deficiencies. In certain applications, the attachment of the sensor module 18 to the bottom of the motor 12 may obstruct the connection of other components. Additionally, the placement of the sensor module 18 at the bottom of the motor 12 prevents the direct measurement of certain performance characteristics of the pump system 10. Accordingly, there exists a need for an improved design that overcomes these and other deficiencies in the prior art.

SUMMARY OF THE INVENTION

In a preferred embodiment, a submersible pumping system includes a motor, a pump driven by the motor, a seal section disposed between the pump and the motor and an inline monitoring package connected between the seal section and the motor. The inline monitoring package preferably includes a sensor array that includes a plurality of sensors configured to measure conditions internal and external to the submersible pumping system. The inline monitoring package further includes a shaft configured to transmit the output from the motor to the pump.

DETAILED DESCRIPTION OF THE PREFERRED EMBODIMENTS

Figure 1:
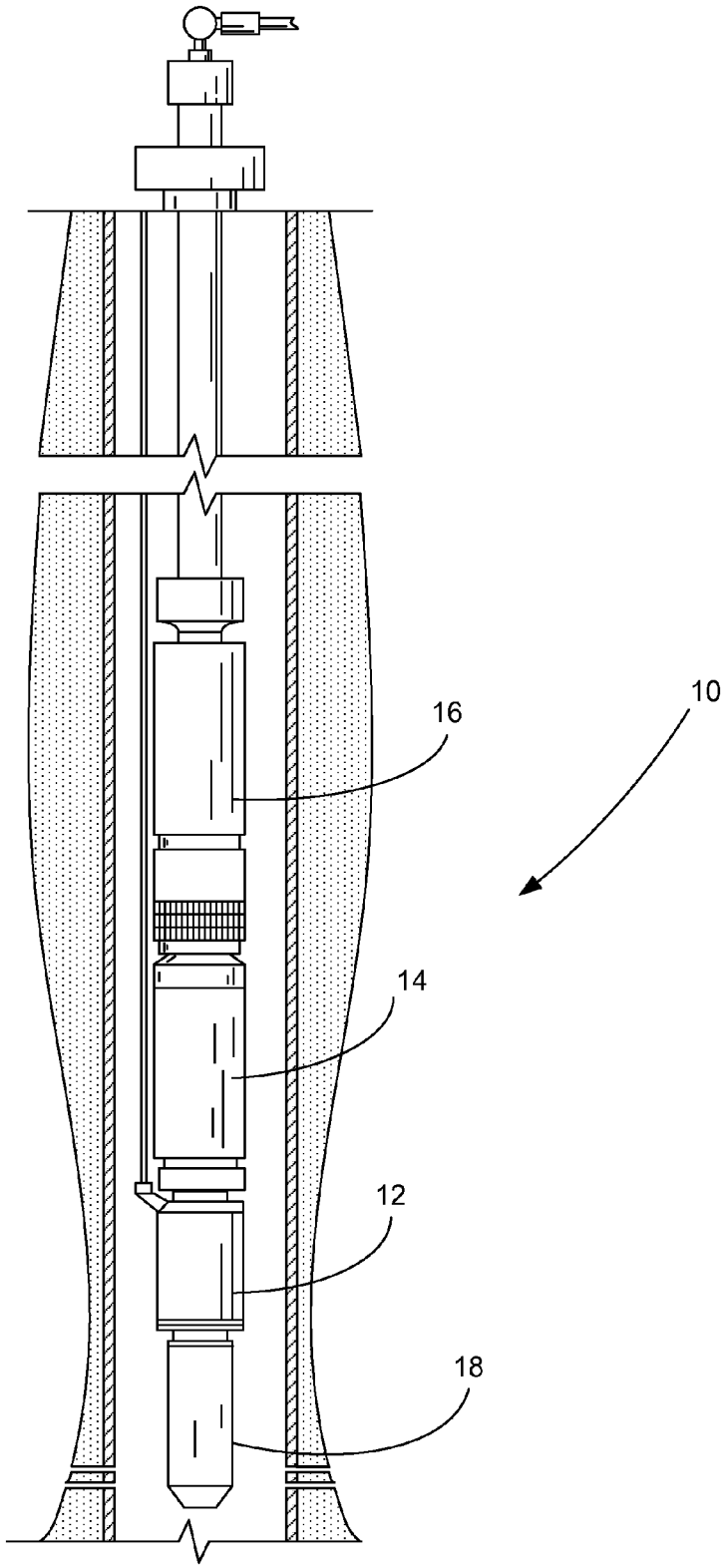
PRIOR ART FIG. 1
FIG. 1 is an elevational depiction of a PRIOR ART electrical submersible pumping system.
Figure 2:
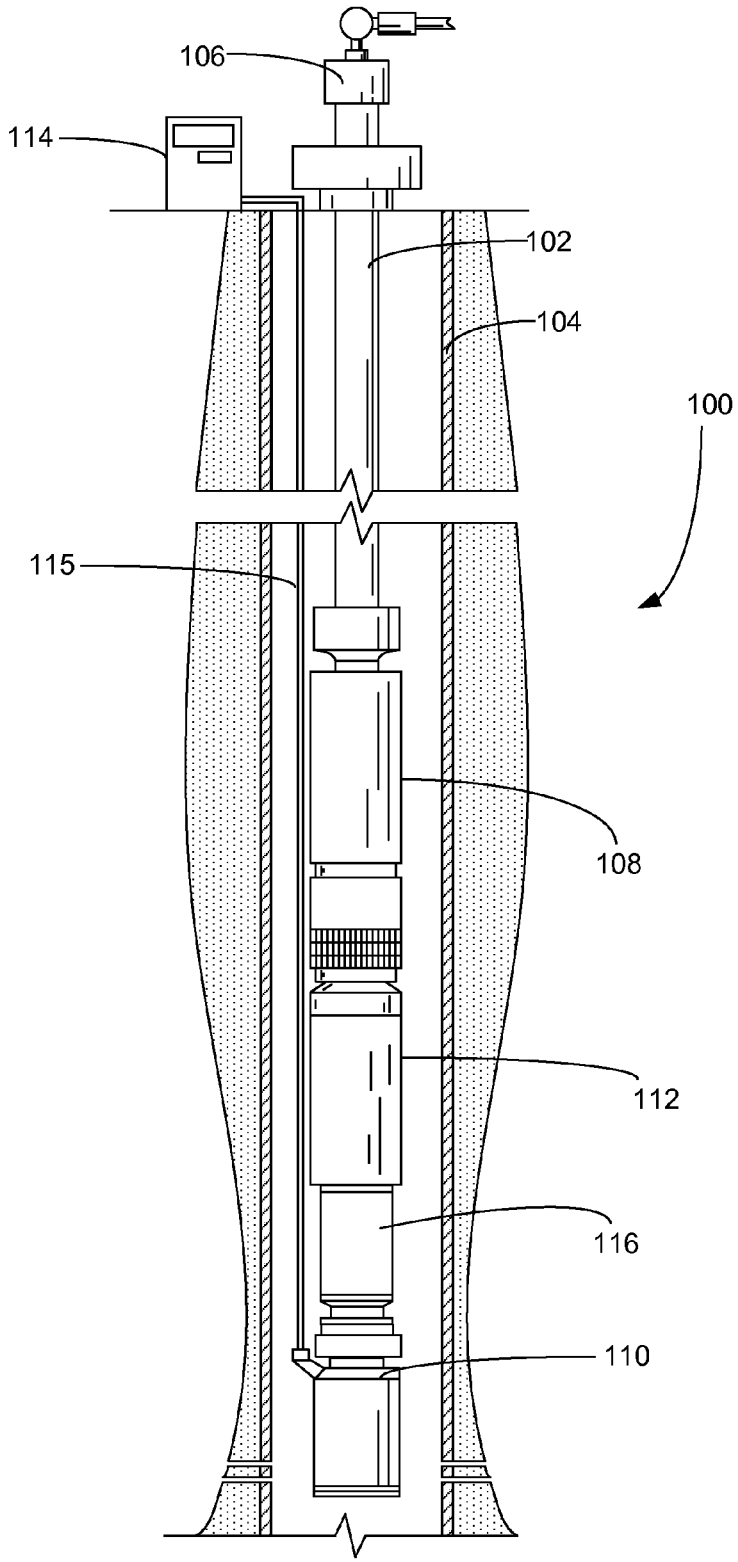
FIG. 2 is an elevational depiction of an electrical submersible pumping system constructed in accordance with a preferred embodiment.

In accordance with a preferred embodiment of the present invention, FIG. 2 shows an elevational view of a submersible pumping system 100 attached to production tubing 102. The submersible pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the submersible pumping system 100 to a wellhead 106 located on the surface. Although the submersible pumping system 100 is primarily designed to pump petroleum products, it will be understood that the present invention can also be used to move other fluids. It will also be understood that, although each of the components of the pumping system are primarily disclosed in a downhole submersible application, some or all of these components can also be used in surface pumping operations.

The submersible pumping system 100 preferably includes some combination of a pump 108, a motor 110 and a seal section 112. The motor 110 is preferably an electrical motor that receives power from a surface-mounted motor control unit 114 through a power cable 115. When energized by the motor control unit 114, the motor 110 drives a shaft that causes the pump 108 to operate. The pump 108 is preferably configured as a multistage turbomachine of the type commonly used in downhole applications. The seal section 112 shields the motor 110 from mechanical thrust produced by the pump 108 and provides for the expansion of motor lubricants during operation. The seal section 112 also isolates the motor 110 from the wellbore fluids present in the pump 108.

The pumping system 100 also includes an inline monitoring package 116. In the presently preferred embodiment, the inline monitoring package 116 is connected between the motor 110 and the seal section 112. The inline monitoring package 116 generally replaces the functionally previously provided by the prior art methodology of connecting a sensor module to the bottom of the motor. It may be desirable to use tandem-motor combinations, multiple seal sections, multiple pump assemblies or other downhole components not shown in FIG. 2.

Figure 3:
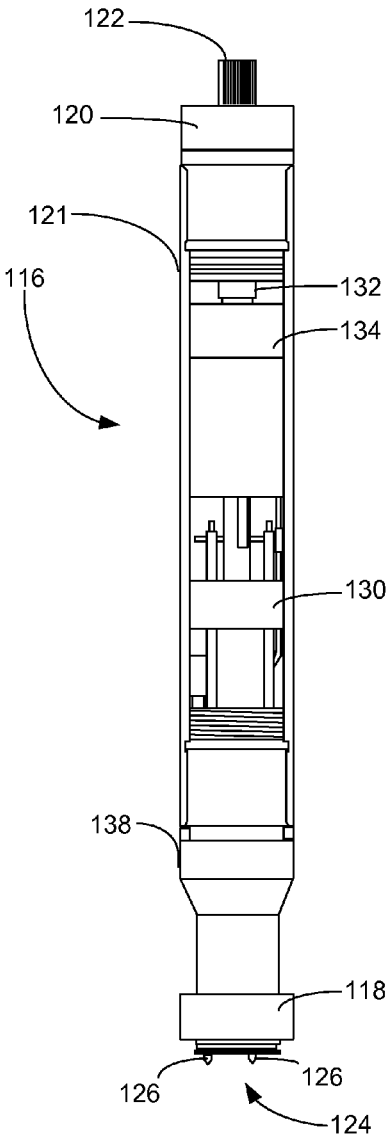
FIG. 3 is a partial cutaway view of an inline monitoring package from the submersible pumping system of FIG. 2.
Figure 4:
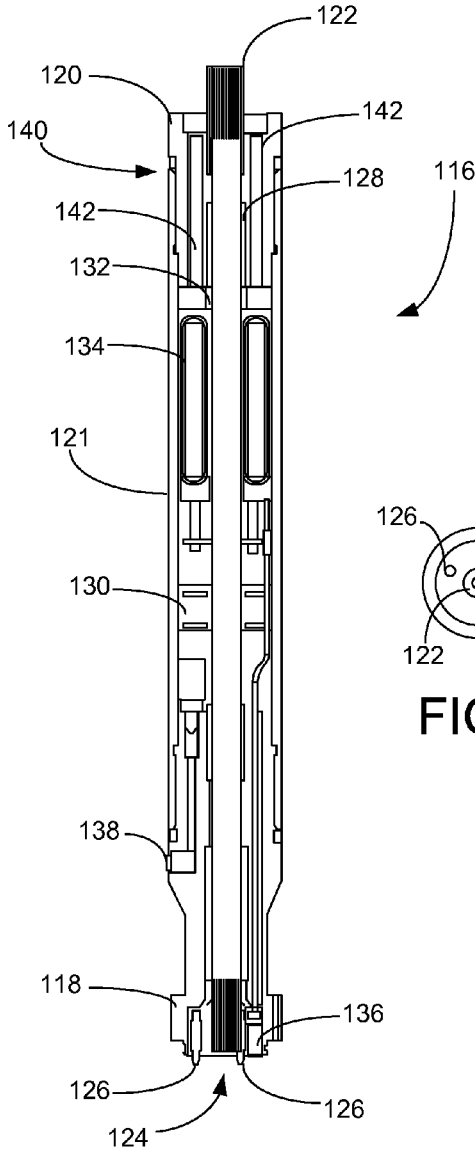
FIG. 4 is a cross-sectional view of the inline monitoring package of FIG. 3.
Figure 5:
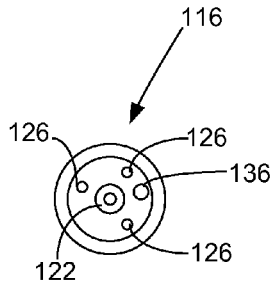
FIG. 5 is a bottom view of the inline monitoring package of FIG. 3.

Turning to FIGS. 3-5, shown therein are partial cutaway, cross-sectional and bottom plan views, respectively, of the inline monitoring package 116. The inline monitoring package 116 preferably includes a base 118, a head 120, a housing 121 and a centrally disposed, rotatable shaft 122. The head 120 and base 118 are preferably configured for a locking threaded engagement with the housing 121. The shaft 122 transmits the rotational output from the motor 110 to the seal section 112. The shaft 122 preferably includes splined ends that are suitable for connection with couplers or directly with the adjacent shaft. Thus, the inline monitoring package 116 is distinct from prior art designs in that it is located above the motor 110 and includes a pass-through shaft 122.

The base 118 is configured for connection to the motor 110. The base 118 preferably includes a y-point or wye point connection 124. The wye point connection 124 preferably includes three motor leads 126 that connect to corresponding leads in the motor 110 (not shown). Electrical submersible motors (such as motor 110) employ three-phase power using one of several wiring configurations known in the art, such as a wye or delta configuration. The wye point connection 124 provides a source of power for the inline monitoring package 116 from the motor 110. In this way, a single connection from the motor control unit 114 can be used to control and power the motor 110 and the inline monitoring package 116.

Furthermore, the inline monitoring package 116 is configured to provide data signals to the surface motor control unit 114 through the wye connection 124. Communication is established by encoding and superimposing information through the power connection between the submersible pumping system 100 and the motor control unit 114. A suitable method for communicating between a surface-mounted control unit and a three-phase electrical submersible pumping system is disclosed in commonly assigned U.S. Pat. No. 6,396,415 issued to Bulmer on May 28, 2002, entitled "Method and System of Communicating in a Subterranean Well," the disclosure of which is herein incorporated by reference.

The head 120 is configured for connection to the seal section 112. In a preferred embodiment, the head 120 incorporates a mechanical seal 128 that is configured to limit the movement of fluids from the seal section 112 into the inline monitoring package 116 along the shaft 122 In an alternate preferred embodiment, the head 120 includes additional sealing components commonly found in the seal section 112, such as labyrinth seals, bellows, elastomer bags, additional mechanical seals and separation chambers.

In the presently preferred embodiment, the inline monitoring package 116 is filled with lubricating fluids. The inline monitoring package 116 further includes a fluid exchange system 140 that includes a series of passages 142 that permit the movement of fluid between the motor 110, the inline monitoring package 116 and the seal section 112. The fluid exchange system 140 is configured to prevent the contamination of clean lubricants with wellbore fluids while permitting the expansion of motor lubricants caused by elevated operating temperatures. It will be appreciated by those of skill in the art that the fluid exchange system 140 may include additional or alternative sealing components, which may include labyrinth seals and u-tube passages. The head 120 and base 118 are configured to cooperate with the fluid exchange system 140 in moving fluids between the inline monitoring package 116 and the seal section 112 and motor 110, respectively.

The inline monitoring package 116 includes an encapsulated microprocessor circuit board 130 and a sensor array (not numerically designated) that is configured to acquire information about the external wellbore environment and operational characteristics of the pumping system 100. In a presently preferred embodiment, the sensor array of the inline monitoring package 116 includes a seal section leakage sensor 132, an inductor assembly 134, a motor temperature sensor 136 and an external pressure sensor 138. Each of these sensors feeds signals directly or indirectly to the circuit board 130, which processes the signals for transmission to the surface-mounted control unit 114 through the power cable 115. The microprocessor circuit board 130 is encapsulated prevent contact with lubricants within the inline monitoring package 116.

The seal section leakage sensor 132 is configured to detect the presence of wellbore fluid in the upper portion of the inline monitoring package 116. If the seal section fails, contaminated wellbore fluids may migrate into the inline monitoring package 116 and ultimately to the motor 110. Accordingly, the presence of wellbore fluid in the inline monitoring package 116 may indicate the failure of the mechanical seal 128 and other sealing components in the head 120. The seal section leakage sensor 132 is preferably configured as a conductivity sensor that monitors a change in conductivity caused by the migration of wellbore fluid into proximity with the seal section leakage sensor 132. Alternatively, the seal section leakage sensor 132 can be configured as an optical sensor that detects changes in response to fixed emission of light through a fluid medium. If the seal section leakage sensor 132 detects a change in the transmission of light through the fluid in the inline monitoring package 116, this may indicate the presence of contaminated well fluids.

The inductor assembly 134 is preferably configured as a single or multiple inductor that encircles the shaft 122. The inductor assembly 134 is designed to detect the rotation of the shaft 122 and output a data signal representative of the speed at which the shaft 122 is rotating. The inductor assembly 134 can also be configured to detect lateral movement or vibration in the shaft 122 as it rotates. In a presently preferred embodiment, the inductor assembly 134 is encapsulated to prevent contact with lubricants within the inline monitoring package 116.

The motor temperature sensor 136 is located in the base 118. The motor temperature sensor 136 provides a reading of the fluid lubricants in the motor 110 and outputs a signal to the circuit board 130. In a preferred embodiment, the motor temperature sensor 136 is configured as a thermocouple that detects the temperature of the motor oil or stator windings in the motor 110. The motor temperature sensor 136 allows for the measurement of direct internal motor temperature.

The external pressure sensor 138 is configured to evaluate the pressure in the wellbore adjacent the inline monitoring package 116. The external pressure sensor 138 is preferably constructed form stainless steel and is configured to withstand the harsh wellbore environment. Because the inline monitoring package 116 is located above the motor assembly 118 and in closer proximity to the pump 108 than prior art sensor packages, the integrated external pressure sensor 138 provides a more accurate measurement of the downhole pressure near the intake of the pump 108. The intake pressure can be more closely approximated by applying corrective factors to the pressure measured by the external pressure sensor 138 in the inline monitoring package 116 based on the height of the intake above the external pressure sensor 138 and the density of the wellbore fluids.

The inline monitoring package 116 may include additional sensors and sensor arrays. For example, it may be desirable to incorporate a filter inductor to measure current leakage from the motor 110. Other sensors and inputs that may be integrated into the inline monitoring package 116 include pump discharge pressure, flow rates and discharge temperature.

The inline monitoring package 116 may optionally include thrust bearings, support bearings and additional mechanical seals. Thrust bearings are used to control the axial displacement of the shaft 122. Support bearings control the lateral position of the shaft 122. In the presently preferred embodiments, the thrust bearings and support bearings are configured as hydrodynamic bearings and constructed using industry-recognized oil-impregnated bearing materials.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An inline monitoring package for use with a submersible pumping system having a pump, a motor and a seal section between the pump and the motor, the inline monitoring package comprising:

a base configured for connection to the motor;

a head configured for connection to the seal section;

a shaft configured to transmit energy from the motor to the seal section;

at least one mechanical seal disposed about the shaft to limit the migration of fluids along the shaft; and a sensor array, wherein the sensor array includes a plurality of sensors configured to measure conditions internal and external to the submersible pumping system.

2. The inline monitoring package of claim 1, further comprising a fluid exchange system for permitting the exchange of fluids between the motor, the inline monitoring package and the seal section.

3. The inline monitoring package of claim 1, wherein the sensor array comprises an encapsulated inductor assembly that encircles the shaft and is configured to measure the rotational movement of the shaft.

4. The inline monitoring package of claim 1, wherein the sensor array comprises a seal section leakage sensor that is configured to detect the migration of fluid from the seal section into the inline monitoring package.

5. The inline monitoring package of claim 1, wherein the sensor array further comprises:

a motor temperature sensor configured to directly measure the temperature of the motor lubricant; and an external pressure sensor configured to measure the pressure of the fluid in the wellbore adjacent the inline monitoring package.

6. The inline monitoring package of claim 5, further comprising an encapsulated microprocessor circuit board configured to process the signals generated by the sensor array and transmit representative data to surface-mounted control equipment by superimposing data signals over power cables.

7. The inline monitoring package of claim 1, wherein the base further comprises a wye point connection suitable for connection with a corresponding wye point connection on the motor.

8. A submersible pumping system comprising:

a motor;

a pump driven by the motor;

a seal section disposed between the pump and the motor; and an inline monitoring package connected between the seal section and the motor, wherein the inline monitoring package includes a sensor array, wherein the sensor array includes a plurality of sensors configured to measure conditions internal and external to the submersible pumping system, wherein the sensor array comprises a seal section leakage sensor that is configured to detect the migration of fluid from the seal section into the inline monitoring package.

9. The submersible pumping system of claim 8, wherein the inline monitoring package further includes a fluid exchange system for permitting the exchange of fluids between the motor, the inline monitoring package and the seal section.

10. The submersible pumping system of claim 9, wherein the inline monitoring package further includes a shaft configured to transmit rotational movement from the motor to the seal section.

11. The submersible pumping system of claim 9, wherein the sensor array comprises an encapsulated inductor assembly that encircles the shaft and is configured to measure the rotational movement of the shaft.

12. The submersible pumping system of claim 11, wherein the sensor array further comprises:

a motor temperature sensor configured to directly measure the temperature of the motor lubricant or stator; and an external pressure sensor configured to measure the pressure of the fluid in the wellbore adjacent the inline monitoring package.

13. The submersible pumping system of claim 12, wherein the inline monitoring package further comprises an encapsulated microprocessor circuit board configured to process the signals generated by the sensor array and transmit representative data to surface-mounted control equipment by superimposing data signals over power cables.

14. The submersible pumping system of claim 9, wherein the inline monitoring package further comprises a wye point connection suitable for connection with a corresponding wye point connection on the motor.

15. A submersible pumping system, comprising:

a submersible electric motor;

a surface-mounted motor controller;

a power cable extending between the submersible electric motor and the surface-mounted motor controller;

a pump driven by the electric motor; and a monitoring package disposed between the pump and motor, wherein the monitoring package includes a shaft for transmitting rotational movement from the electric motor to the pump, wherein the monitoring package further comprises a fluid exchange system that is configured to accommodate the thermal expansion of lubricants from the motor.

16. The submersible pumping system of claim 15, wherein the monitoring package further comprises:

a sensor array configured to measure internal and external variables and output signals representative of the internal and external variables;

a circuit board configured to process signals generated by the sensor array; and a wye point connection configured to transfer signals from the circuit board to the electric motor, power cable and surface-mounted motor controller.

* * * * *